United States Patent [19]

Audeh

[11] 4,079,013

[45] Mar. 14, 1978

[54] GREASE THICKENERS

[75] Inventor: Costandi A. Audeh, Princeton, N.J.

[73] Assignee: Mobil Oil Corporation, New York, N.Y.

[21] Appl. No.: 623,281

[22] Filed: Oct. 17, 1975

[51] Int. Cl.[2] ..... C10M 1/24; C10M 3/18; C10M 5/14; C10M 7/20

[52] U.S. Cl. ..... 252/41

[58] Field of Search ..... 252/41, 32

[56] References Cited

U.S. PATENT DOCUMENTS

| | | | |
|---|---|---|---|
| 2,710,838 | 6/1955 | Morway et al. | 252/41 |
| 2,868,729 | 1/1959 | Nelson et al. | 252/39 |
| 2,980,615 | 4/1961 | Morway et al. | 252/41 |
| 3,076,763 | 2/1963 | Nelson | 252/39 |
| 3,271,310 | 9/1966 | LeSuer | 252/41 |
| 3,591,499 | 7/1971 | Morway et al. | 252/41 |
| 3,791,973 | 2/1974 | Gilani et al. | 252/41 |
| 3,809,649 | 5/1974 | VanDoorne | 252/35 |
| 3,836,468 | 9/1974 | Kenney et al. | 252/33.6 |

*Primary Examiner*—Delbert E. Gantz
*Assistant Examiner*—Irving Vaughn
*Attorney, Agent, or Firm*—Charles A. Huggett; Raymond W. Barclay; Howard M. Flournoy

[57] ABSTRACT

Grease compositions are provided containing, as thickeners, alkali metal salts of a gamma keto acid.

3 Claims, No Drawings

GREASE THICKENERS

BACKGROUND OF THE INVENTION

1. Field of the Invention

This invention relates to grease compositions and, in one of its aspects, relates more particularly to grease compositions comprising, as vehicles, liquid lubricant materials and particularly low-grade hydrocarbon stocks such as solvent extracts brought to grease consistencies with a novel thickening agent as hereinafter described.

2. Description of the Prior Art

Prior to the present invention, thickeners of grease compositions have been made from salts of plant or animal-derived fatty acids. In this respect, it is found to be highly desirable, from a practical and economic viewpoint to employ thickeners that maintain total reliance on available lubricant oils and manufactured chemicals.

SUMMARY OF THE INVENTION

In accordance with the present invention, it has now been found that thickening agents, comprising alkali metal salts of gamma keto acids can be formulated into greases, employing, as vehicles, liquid synthetic or mineral oil lubricants, especially low-grade hydrocarbon stocks, such as solvent extracts, thereby maintaining total reliance on readily available lubricant base stocks and manufactured chemicals, and, in addition, in the formulation of the above-described thickeners, involving chemical reactions which are simple and are not subject to the normal vagaries of the traditional grease-making techniques.

In general, the novel grease thickener is produced by reacting a liquid hydrocarbon-containing material with an alkali metal at a temperature of at least about 100° C to form the corresponding alkali metal salts of hydrocarbons containing reactive hydrogen in this material, and followed by reacting the products thus obtained with a cyclic acid anhydride to form the corresponding alkali metal salts of gamma keto acids. Particularly preferred liquid hydrocarbon-containing materials, as the vehicle, are furfural or phenol extracts derived from petroleum solvent refining processes, which are readily commercially available. These are by-products from the solvent refining of distillate fractions, i.e. in solvent refining, a crude oil distillate fraction is mixed with a solvent, usually furfural or phenol. In conducting the above-described synthesis of the alkali metal salts of gamma keto acids, the liquid hydrocarbon-containing material can, in place of or in addition to the alkali metal, be reacted with a metal alkyl, such as n-butyl lithium or alkenyl sodium, if so desired. Representative of the cyclic acid anhydrides are compounds having the following structures:

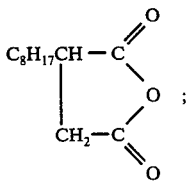

;

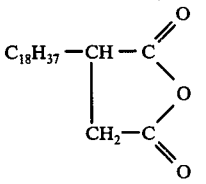

or

-continued

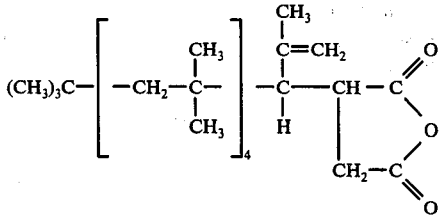

In its more specific aspects, the production of the alkali metal salts of gamma keto acids can be carried out in accordance with the following sequence:

The preparation of an alkali salt of hydrocarbons intrinsic to a lubricating oil or its extract is illustrated by the following reactions (1) or (2).

$$2M^{o} + 2RH \longrightarrow 2R^{-}M^{+} + H_2\uparrow \quad (1)$$

$$R_1^{-}M^{+} + RH \longrightarrow R^{-}M^{+} + R_1H\uparrow \quad (2)$$

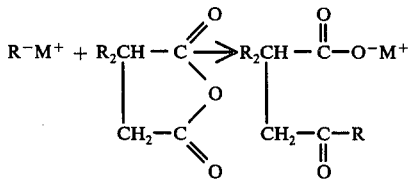

(3)

More specifically, with the foregoing reactions (1) or (2) in view, an alkali metal, M°, for example sodium, potassium or lithium, is reacted with a RH mineral lubricating oil or its extract. This reaction results in an alkali metal salt of any reactive hydrocarbon intrinsic to the oil or its extract. Reaction (1) is generally conducted with vigorous stirring and agitation at a temperature from about 100° to 200° C. When reaction (2), is employed, the alkali metal salt of a volatile hydrocarbon $R_1M^+$, such as n-butyl lithium or phenyl sodium is mixed slowly with RH, the lubricating oil or its extract in an inert atmosphere at ambient temperature.

In reaction (3) is illustrated the preparation of the alkali metal salt of a gamma keto acid. In this reaction, a solution of an alkyl substituted acid anhydride in a volatile solvent, for example tetrahydrofuran, is added to the products obtained in either reaction (1) or reaction (2). After the reaction is completed, the solvent is removed and the thickener viz. an alkali metal salt of a gamma keto acid is obtained. In the foregoing reactions (1), (2) and (3), R is a group derived from the reactive hydrocarbons intrinsic to the oil or its extract; $R_1$ is, preferably, an alkyl group having from 3 to 5 carbon atoms, $R_2$ is an alkyl or alkenyl group having from 8 to 30 carbon atoms; and M is an alkali metal. The vehicle employed can be either a mineral oil or synthetic lubricating oil.

DESCRIPTION OF SPECIFIC EMBODIMENTS

The following examples will serve to illustrate the improved characteristics of greases formulated with the alkali metal salts of gamma keto acids of the present invention, employed as thickening agents.

As shown in the following Table, measured amounts of the alkali metal salts of gamma keto acids were employed for thickening a furfural extract derived from solvent refining process to the consistency of a grease. In this respect, a measured amount of the thickener was added to the required quantity of oil and the material was heated to 150° C with stirring. The thickened oils were further homogenized by two passes through a three-roll mill. Employing different proportions of the thickener in the blend, resulted in greases of different penetrations. In the Table, a grease was employed which was produced in accordance with the sequence shown in the above-described reactions (1), (2) and (3) in which $R_1$ was a mixture of hydroaromatic compounds, $R_2$ equalled $C_{18}H_{37}$, and M was lithium, as illustrated in the above-described reaction (3). R, as previously indicated, was a group derived from the reactive hydrocarbons intrinsic to the oil.

TABLE

| | Alkali-Metal Salts of Gamma Keto-Acid Thickened Furfural Extracts | | | |
|---|---|---|---|---|
| Ex. | Thickener Wt. %[a] | ASTM Penetration 1/2 scale Unworked/ Worked 60 X | Dropping Point ° F | Oil Separation[b] Wt. % |
| 1 | 32 | 99/107 | 417 | 16.4 |
| 2 | 28 | 148/153 | 422 | 18.8 |
| 3 | 24 | 168/167 | 423 | 28.4 |

[a]Calculated from syntheses data.
[b]30 hours at 300° F.

As will be apparent from the foregoing examples of the Table, greases formulated with the alkali metal salts of gamma keto acids of the present invention, as thickeners, exhibit satisfactory penetrations, dropping points and oil separation.

While the present invention has been described with reference to preferred compositions and modifications thereof, it will be apparent to those skilled in the art that departure from the preferred embodiments can be effectively made and are within the scope of the specification.

I claim:

1. A grease composition comprising as the vehicle a liquid hydrocarbon-containing material selected from furfural or phenol extracts derived from the solvent-refining of distilled hydrocarbon fractions and as thickener an alkali metal salt of a gamma keto acid prepared by (1) reaction in substantially equimolar amounts a liquid hydrocarbon containing material selected from said furfural or phenol extracts and an alkali metal or an alkali metal alkyl at a temperature of from ambient to about 200° C and (2) then reacting in substantially equimolar amounts the resulting alkali metal salts and an aliphatic cyclic anhydride to produce an alkali metal salt of a gamma keto acid derived thereby from said hydrocarbon-containing material intrinsic to said vehicle.

2. A grease composition as defined in claim 1 comprising a major proportion of said extract and a minor proportion of said thickener.

3. A grease composition as defined in claim 1 wherein said thickener is produced by reacting a liquid hydrocarbon-containing material with a metal alkyl to form the corresponding alkali metal salts of hydrocarbons containing reactive hydrogen in said material, and reacting the product thus obtained with a cyclic acid anhydride to form the corresponding alkali metal salts of gamma keto acids.

* * * * *